United States Patent [19]

Schildkraut

[11] Patent Number: 4,494,810

[45] Date of Patent: Jan. 22, 1985

[54] ANTI-DECOUPLING DEVICE FOR AN ELECTRICAL CONNECTOR

[75] Inventor: Alan L. Schildkraut, Sidney, N.Y.

[73] Assignee: The Bendix Corporation, Southfield, Mich.

[21] Appl. No.: 493,487

[22] Filed: May 11, 1983

[51] Int. Cl.[3] ..... H01R 13/623

[52] U.S. Cl. ..... 339/89 M; 339/DIG. 2

[58] Field of Search ..... 339/89 R, 89 L, 89 M, 339/90 R, 90 C, DIG. 2; 285/82, 89, 92; 267/156; 192/72, 81 C

[56] References Cited

U.S. PATENT DOCUMENTS

| | | | |
|---|---|---|---|
| 718,366 | 1/1903 | Freund | 83/345 |
| 957,504 | 5/1910 | Frenot | 411/143 |
| 1,011,871 | 12/1911 | Smoke | 411/331 |
| 2,928,514 | 3/1960 | Clausing et al. | 192/8 K |
| 3,018,097 | 1/1962 | Johansson | 267/156 |
| 3,222,046 | 12/1965 | Thorner | 267/156 |
| 3,517,371 | 6/1970 | Buckley | 339/89 |
| 3,532,197 | 10/1970 | King | 267/156 |
| 3,594,700 | 7/1971 | Nava | 339/89 R |
| 3,598,210 | 8/1971 | Barr | 192/72 |
| 3,646,495 | 2/1972 | Cowmeadow | 339/46 C |
| 3,663,926 | 5/1972 | Brandt | 339/89 R |
| 3,669,472 | 6/1972 | Nadsady | 339/89 R |
| 3,786,396 | 1/1974 | Kemmer | 339/89 R |
| 3,801,954 | 4/1974 | Dorrel | 339/90 R |
| 3,917,373 | 11/1975 | Peterson | 339/89 R |
| 3,971,614 | 7/1976 | Paoli et al. | 339/89 |
| 4,007,953 | 2/1977 | Powell | 339/89 R |
| 4,030,798 | 6/1977 | Paoli | 339/89 R |
| 4,056,298 | 11/1977 | Cooper | 339/89 M |
| 4,066,315 | 1/1978 | Arneson | 339/89 M |
| 4,165,910 | 8/1979 | Anderson | 339/89 M |
| 4,359,255 | 11/1982 | Gallusser et al. | 339/90 R |
| 4,427,100 | 1/1984 | Rude et al. | 192/81 C |
| 4,437,552 | 3/1984 | Toyama | 192/81 C |

*Primary Examiner*—John McQuade

*Attorney, Agent, or Firm*—C. D. Lacina

[57] ABSTRACT

A pair of rotatable coupling nuts (46, 76) are nested and mounted for relative rotation to a plug shell (10) and first and second cylinders (28, 62) are arranged coaxially to cooperate with a coil (90) connected to the inner coupling nut (46) for restraining unwanted rotation thereof relative to the shell, the inner and outer coupling nuts having, respectively, an opening (60) and a dog (84) extending radially inward into the opening for driving the inner coupling nut in coupling/uncoupling directions, coil (90) having one end (92) secured to inner coupling nut (48), the other end disposed in the opening (60) and the intermediate portion thereof adapted to be tightly coiled and partially uncoiled.

9 Claims, 5 Drawing Figures

FIG. 1
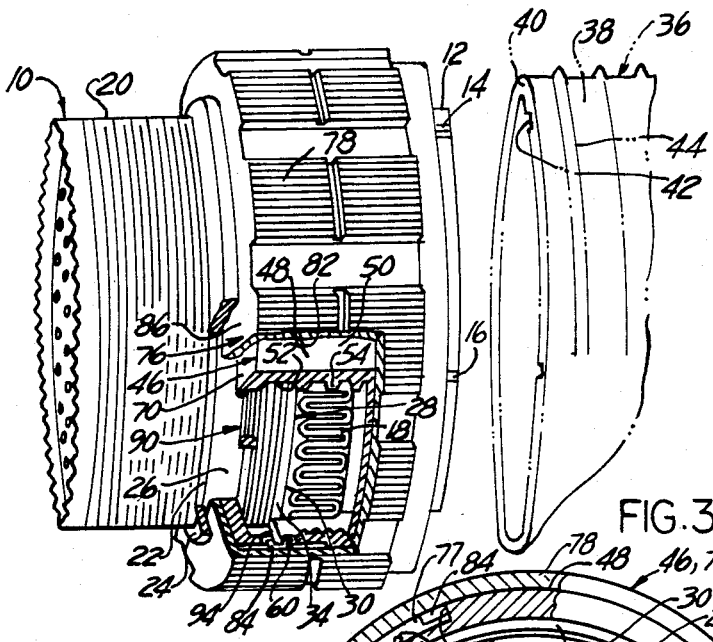
FIG. 3
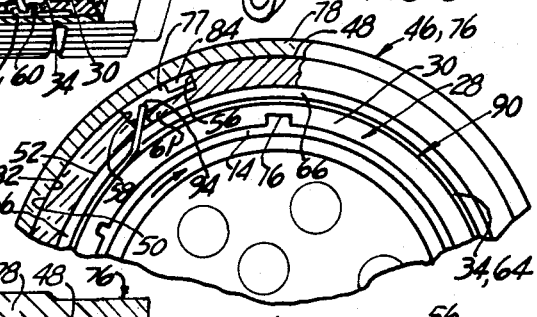
FIG. 2
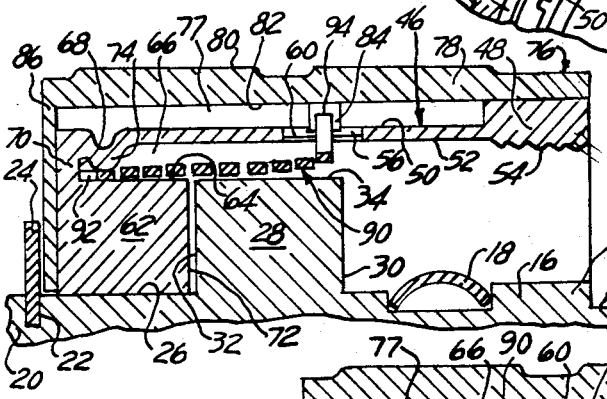
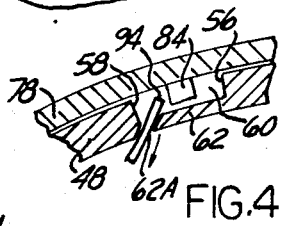
FIG. 4
FIG. 5
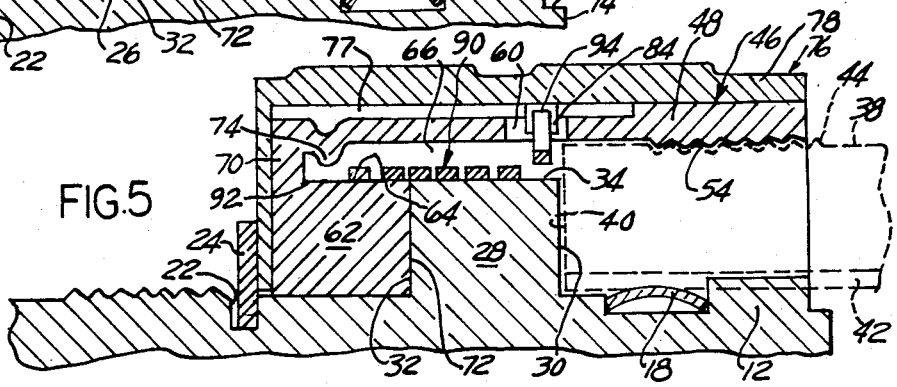

ANTI-DECOUPLING DEVICE FOR AN ELECTRICAL CONNECTOR

This invention relates to an anti-decoupling device for an electrical connector.

Electrical connector assemblies are generally comprised of two separate connector members and a coupling member mounted to one of the connector members and adapted to connect to the other connector member, each of the respective connector members supporting an electrical contact therein for mating when the connector members are connected together. During mating and unmating the connector members must be easily coupled and decoupled with use of reasonable force. Once mated and in use, however, the connector assembly must remain connected despite vibrational and/or other forces which might be applied to the connector assembly and which might tend to uncouple the assembly.

Various anti-decoupling devices for resisting unwanted rotation are known. In U.S. Pat. No. 4,109,990 issuing Aug. 29, 1978 to Waldron et. al for an "Electrical Connector Assembly Having Anti-Decoupling Mechanism", a straight spring beam is radially interposed between the coupling member and one of the connector members, the one connector member having a plurality of ratchet teeth arranged annularly and extending radially outward therefrom and the spring beam having a medial tooth arranged such that when the coupling member is rotated in either direction the medial tooth engages successive of the ratchet teeth to resist rotation. The assembly provides an anti-rotation device which is self-contained and protected during use.

However, while such a spring beam is suitable for use in many applications, in some vibration environments, the straight beam could bow upwardly and the medial tooth removed from positive engagement with the ratchet teeth resulting in the coupling nut backing-off from tightly coupled relation, such back-off causing the connector members to axially hammer against one another.

A desirable anti-rotation device for a separable electrical connector would be protectively enclosed and self-contained, would readily permit connection and/or disconnection and woud resist uncoupling torques to resist unwanted uncoupling of the assembly formed.

Accordingly, the present invention is directed to an electrical connector having improved anti-decoupling which overcomes the difficulties and disadvantages associated with prior electrical connectors. An electrical connector assembly of the present invention comprises a pair of generally cylindrical connector members adapted for mating engagement along their primary axis and a coupling nut rotatably mounted to one of the connector members for coupling the connector members together, the one connector member including an annular flange and the coupling nut comprising a generally cylindrical coupling sleeve adapted to connect to the other connector member upon coupling rotation of the coupling nut in one direction and a radial flange adapted to abut the annular flange for rotation thereabout, whereby coupling rotation of the coupling nut draws the connector members together and the flanges tightly against one another.

The anti-decoupling mechanism for restraining the coupling nut against unwanted uncoupling rotation in the other direction is characterized by an elongated coil connected to the coupling nut for coiling about the coupling nut and the one connector member as a result of the coupling nut rotating from a first position to a second position and a second coupling nut disposed around the first coupling nut for transmitting torque to rotate the first coupling nut in opposite directions, the coil being uncoiled (i.e., free to slide) relative to the one connector member when in the first position whereby the first coupling nut is not restrained from rotating relative to either of the connector members and tightly coiled relative to the first coupling nut and the one connector member when in the second position whereby friction forces developed between the tightly coiled relation and the tightly abutted flanges restrain the first coupling nut for rotating relative to the other connector member, the second coupling nut being coaxially mounted for relative rotation about the first coupling nut and including a dog extending radially inward threfrom for driving the first coupling nut in either of the coupling and/or uncoupling directions.

An advantage of this invention is a self contained anti-rotation resisting device which is readily adaptable to standard plug shells.

One way of carrying out the invention is described below with reference to the drawings which illustrate one specific embodiment of this invention, in which:

FIG. 1 as a side view, partially in section, of an electrical connector assembly including a coil for resisting uncoupling.

FIG. 2 is a side view, in section, of the coil when uncoiled.

FIG. 3 is a front end view, patially in section, of the coil in FIG. 1 being coiled for resisting uncoupling.

FIG. 4 is a detail view, in section, of inner and outer coupling nuts.

FIG. 5 is a side view, partially in section, of the coil when coiled about the inner coupling nut and one connector member for providing anti-decoupling according to this invention.

Referring now to the drawings, FIG. 1 shows an electrical connector assembly comprising a first shell 10, a second shell 36 (in phantom) positioned for mating, a coupling nut 56 rotatably mounted to the first shell and having a coupling sleeve 48 for connecting the first shell to the second shell in mating relationship, a retaining ring 24 for retaining the coupling nut on the first shell and an anti-decoupling mechanism for resisting unwanted uncoupling of the assembly.

The anti-decoupling mechanism resists uncoupling roation of coupling nut 46 relative to first shell 10 and is characterized by an elongated coil 90 and a pair of coaxial, generally cylindrical and relatively co-rotatable coupling nuts teleseoped together in nested relation on first shell 10 with coupling nut 46 being the inner coupling nut and including a second and outer coupling nut 76, the elongated coil 90 being connected to inner coupling nut 46 and operated on by outer coupling nut 76 for tightly coiling and partially uncoiling about both inner coupling nut 46 and first shell 10 as a result of outer coupling nut 76 rotating in opposite directions relative to inner coupling nut 46, outer coupling nut 76 being provided to transmit coupling/uncoupling torques and to initiate uncoiling release of coil 90 from its tight contacting relationship.

The first shell 10 is generally cylindrical and comprises a forward portion 12 having forward face 14, a rear portion 20 and an annular flange 28 medially of the shell portions, rear portion 20 including an annular groove 22 for receiving retaining ring 24 and an annular wall 26 circumjacent the annular flange. The outer surface of forward portion 12 includes one or more axial keys 16 for orienting the first shell relative to the second shell and a shield spring 18 for protecting the mated assembly against EMI interference.

The second shell 36 is generally cylindrical and comprises a forward portion 38 having a transverse forward face 40, the forward portion 38 including thread 44 on an outside surface thereof and an axial keyway 42 on an inside surface thereof for receiving respective keys 16 on first shell 10.

Although not shown, the shells 10, 36 would include matable pin and socket type contacts with each respective set of contacts being retained within a dielectric insert. Typically first shell 10 would be characterized as a plug-type connector member and would include the female-type (i.e., socket) electrical contacts and second shell 36 would be characterized as a receptacle connector and would include the male-type (i.e., pin) electrical contacts that mate within the socket-type contacts in first shell 10. Of course, the pin and socket contacts could be otherwise.

Inner coupling nut 46 is sized to be received over rear portion 20 of first shell 10 and comprises a generally cylindrical coupling sleeve 48 having thread 54 on an inner wall 52 thereof for engaging with the external thread 44 on second shell 36 and a radial flange 70 extending radially inward therefrom for mounting to first shell 10, radial flange 70 abutting annular flange 28 and circumposing annular wall 26.

Outer coupling nut 76 comprises a generally cylindrical sleeve 78 and a radial flange 86 extending radially inward therefrom, sleeve 78 and flange 86, respectively, being adapted to telescope about inner coupling sleeve 48 and abut inner radial flange 70.

Preferably and in accord with this invention, inner coupling sleeve 48 includes an opening 60 extending radially therethrough, outer coupling sleeve 78 includes a dog 84 extending radially inward therefrom and disposed within opening 60 of inner coupling nut 46 and elongated coil 90 has its opposite ends 92, 94 connected to inner coupling nut 46 and its intermediate portion adopted to be coiled and uncoiled. The connection of each respective coil end is seen in FIG. 2 for end 92 and FIG. 4 for end 94, the coil end 92 being fixedly secured and the coil end 94 being gripped by the coupling nut during coupling rotation and driven inwardly during uncoupling rotation. The intermediate portion of coil 90 is partially uncoiled (i.e., slidable) relative to first shell 10 when in a first position whereby inner coupling nut 46 is not restrained from rotating relative to either of the connector shells 10, 36 and tightly coiled relative to both inner coupling nut 46 and first shell 10 when in a final second position whereby friction forces developed between the tightly coiled relation restrain inner coupling nut 46 from rotating relative to first shell 10, external torques to outer coupling sleeve 78 being transmitted by dog 84 to inner coupling sleeve 48 to drive the inner coupling sleeve and wind coil 90 (to provide a gripping force) or unwind coil 90 (which releases the gripping force). Torques generated by vibration which would tend to uncouple inner nut 48 cause coil 90 to wind, this increases the gripping force and motion is prevented. Outer coupling nut 76 "floats" and is not massive enough to provide torsional force (vibration) adequate to push on end 94 and release gripping force. Vibration will not do this, it takes human force.

FIG. 2 shows first shell 10 receiving inner and outer coupling nuts 46, 76, disposition of coupling sleeves 48, 78 and connection of coil 90. As shown coil 90 is partially uncoiled relative to shell 10. Annular flange 28 extends radially from shell 10 and includes front face 30, rear face 32 and a cylindrical wall 34 therearound.

Inner coupling sleeve 48 has inner and outer walls 52, 50, respectively, with opening 60 extending therebetween and includes radial flange 70 extending radially inward therefrom, radial flange 70 being clearance fit for rotation about annular wall 26 and including an inner transverse end wall 68.

Preferably and in accord with this invention, the annular flange 28 is axially extending and defines a first cylinder coaxial with the primary axis of shell 10 and a second cylinder 62 extends axially inward from end wall 68, the second cylinder being coaxial with the primary axis of shell 10 and having an outer cylindrical wall 64 coextensive with cylindrical wall 34 and a transverse end face 72 adapted to abut rear face 32 of annular flange 28, an annular recess 66 being defined between outer cylindrical wall 64 and inner wall 52 of coupling sleeve 48. When the first and second cylinders 28, 62 are abutted the respective outer cylindrical walls 34, 64 cooperate to define a continuous cylinder or mandrel around which coil 90 may be tightly wound or unwound with annular recess 66 defining an annulus within which the coil may partially uncoil.

Outer coupling sleeve 78 has, respectively, inner and outer walls 82, 80 and the second radial flange 86 extending radially inward therefrom, second radial flange 86 being sized to clearance fit about annular wall 26 for rotation thereabout and adapted to abut first radial flange 70 of inner coupling nut 46, the radial flanges 70, 86 being retained rotatably to plug shell 10 by retaining ring 24, the outer and inner coupling sleeves 78, 48 being coaxially nested for relative rotation. An annular cavity 77 is defined between outer wall 50 of inner coupling sleeve 48 and inner wall 82 of outer coupling sleeve 78.

Coil 90 is elongated and substantially rectangular in cross-section with the short dimension of the cross-section being disposed along a radius passing through the connector axis and the long dimension of the cross-section being aligned in the axial direction to define flat surfaces. The coil includes a mediate portion between opposite ends 92, 94 with one end 94 being free and extending through opening 60 and into annular cavity 77 to be acted on by dog 84, the other end 92 being disposed adjacent to end wall 68 and secured to inner coupling nut 46 and the mediate portion thereof being coiled about the cylindrical walls 34, 64 comprising mandrel 62, 28. As shown the mediate portion of coil 90 is partially uncoiled relative to the mandrel and has its opposite lateral faces disposed in side-by-side relation such that the mediate portions do not overlap themselves. A radial indent 74 into coupling sleeve 48 deforms the sleeve walls 50, 52 thereof radially inward to secure end 92 of the coil 90 within the annular recess 66 and to first cylinder 62.

FIG. 3 shows opening 60 including angularly spaced first and second sidewalls 56, 58, the sidewalls representing limits on relative rotation between the coupling nuts, the free end 94 of coil 90 being threaded into opening 60, dog 84 abutting sidewall 56, and inner coupling nut 46 being constrained to rotate in a coupling direction as a result of dog 84 on outer coupling nut 76 being driven against sidewall 56 whereby mediate portion of coil 90 is tightly coiled about cylindrical walls 34, 64 describing mandrel 28, 62.

Preferably and in accord with this invention, free end 94 of coil 90 is loosely received in opening 60 and dog 84 is adapted to push the coil inwardly upon uncoupling rotation of outer coupling sleeve 78 to initiate partial uncoiling of coil 90.

The resiliency of the coil always assures that an end portion is thrust into the opening 60 upon release of dog 84.

FIG. 4 shows inner coupling sleeve 48 and detail of opening 60. A web 62 having an angled slot 62A is disposed between sidewalls 56, 58 for loosely receiving free end 94 of the coil. On coupling rotation, wherein dog 84 abuts sidewalls 56, a two point contact is placed by slot 62A on the coil end portion to draw the coil mediate portion tightly about the mandrel whereas, on uncoupling rotation, dog 84 partially drives against coil end 94 to push the coil radially inward through the slot to initiate uncoiling the coil and abuts sidewall 58 to constrain contained uncoupling rotation of the coupling nuts.

FIG. 5 shows coil 90 tightly wrapped about first and second cylinders 28, 62 and frictionally gripping cylindrical walls 34, 64, transverse end face 72 tightly abutting rear face 32 of annular flange 28 and forward face 40 abutting front face 30 of annular flange 28. To enhance EMI protection forward portion 44 of receptacle shell 36 depresses shield spring 18 and forward face 40 abuts front face 30 of annular flange 28.

Although end 94 of coil 90 is shown unsecured, securing this end may be desirable.

Outer coupling nut 76 would preferably be comprised of a material having low mass such that when the coil 90 is in its coiled position and the connectors 10, 20 are coupled, external vibration forces would not be sufficient to drive dog 84 and impose a force sufficient to act on the drive coil end 94 inward to initiate release. In some applications, provision of a bias member is opening 60 may be desirable for constantly biasing dog 84 oppositely of sidewall 58. Further, although coupling nut 76 is used, only a single release collar, such as the outer coupling sleeve 78, is essential for transmitting torques.

I claim:

1. An anti-decoupling mechanism for a separable electrical connector assembly, the electrical connector assembly comprising a pair of generally cylindrical connector members adapted for mating engagement along their primary axis and a coupling nut rotatably mounted to one of said connector members for coupling the connector members together, said one connector member including an annular flange and said coupling nut comprising a generally cylindrical coupling sleeve adapted to connect to the other connector member upon coupling rotation of the coupling nut in one direction and a radial flange having a forwardly facing end wall abutting the annular flange for rotation thereabout, said coupling rotation of the coupling nut drawing the flanges tightly against one another, the anti-decoupling mechanism restraining said coupling nut against unwanted uncoupling rotation in the other direction and characterized by:

coil means connected to the coupling nut for coiling about said coupling nut and said one connector member as a result of the coupling nut rotating from a first position to a second position, said coil means being uncoiled relative to said one connector member when in the first position whereby the coupling nut is not restrained from rotating relative to either of the connector members and tightly coiled relative to said coupling nut and said one connector member when in the second position whereby friction forces developed between the tightly coiled relation and the tightly abutted flanges restrain the coupling nut from rotating relative to the other connector member; and means for driving the coupling nut in either of said directions.

2. The invention as recited in claim 1 wherein said coupling nut includes a first cylinder member, said annular flange defines a second cylinder member and said coil means comprises an elongated band having first and second end portions with said first end portion being firmly secured to the first cylinder member and said second end portion being received by said coupling sleeve, said first cylinder member extending axially forward from the radial flange and abutting the second cylinder member, said abutted first and second cylinder members being coaxial with the primary axis and defining a cylindrical mandrel for receiving the remainder of said elongated band, said band being of sufficient length to be coiled around said second cylinder member several times.

3. The invention as recited in claim 2 wherein said coupling sleeve includes an opening and said drive means comprises a generally cylindrical collar coaxially mounted for relative rotation about said coupling sleeve, said opening being adapted to receive the second end portion of the band and having angularly spaced sidewalls, said collar including a dog extending radially inward therefrom and received within said opening, said dog being adapted to be driven into abutment against either of the sidewalls to drive the coupling sleeve in either of said directions.

4. The invention as recited in claim 3 wherein said second end portion is slidably threaded into said opening and said dog is adapted to drive said band inwardly upon rotation in the uncoupling direction and thereby assist uncoiling of the band.

5. The invention as recited in claim 2 wherein said elongated band is generally rectangular in cross-section with the long dimension thereof being aligned with the primary axis.

6. In an electrical connector assembly of the type including a pair of connector members and a coupling nut rotatably mounted to one of said connector members for coupling the connector members together, said one connector member including an annular flange and said coupling nut including a radial flange for mounting the coupling nut to said one connector member and a coupling sleeve for engaging the other connector member upon rotation of the coupling nut in one direction, the improvement comprising clutch means for resisting uncoupling rotation of the coupling nut in the other direction, said clutch means being characterized by:

a cylindrical member extending axially inward from said radial flange, said cylindrical member having a cylindrical outer wall and a transverse end wall adapted to abut said annular flange;

said annular flange extending radially outward from said one connector member and defining thereabout a second cylindrical member including a second cylindrical outer wall; and an elongated coil for restraining relative rotation between the coupling nut and said one connector member, said coil being adapted to be tightly wound several times around each of the cylindrical outer walls and having one of its ends secured to the coupling nut, the other of its ends received by the coupling sleeve and its intermediate portion disposed between the ends thereof whereby as the coil is tightly wrapped around the outer surfaces, frictional forces developed therebetween restrain uncoupling rotation of the coupling nut relative to said one connector member.

7. The invention as recited in claim 6 wherein said first and second cylindrical outer walls are coaxially disposed relative to the primary axis of the connector members and further comprising drive means for rotatably driving said coupling nut in either coupling or uncoupling directions.

8. The invention as recited in claim 7 wherein said drive means includes a second coupling nut coaxially mounted about the first coupling nut for relative rotation thereabout, said second coupling nut including a generally cylindrical collar having a dog extending radially inward therefrom and said first coupling nut including an opening defining angularly spaced sidewalls, said dog being received within said opening and adapted to rotate between each of said sidewalls for driving the coupling nuts together as a unit.

9. The invention as recited in claim 8 wherein said outer end of the coil being non-securedly received in said opening.

* * * * *